US006407676B1

(12) United States Patent
Tanji et al.

(10) Patent No.: US 6,407,676 B1
(45) Date of Patent: Jun. 18, 2002

(54) MAGNETOSTRICTIVE RESONATOR, ROAD IN WHICH THE RESONATOR IS BURIED AND METHOD OF BURYING THE RESONATOR

(75) Inventors: Yoshihiko Tanji; Toshihiro Yoshioka, both of Osaka; Joji Kamata, Kanagawa, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/141,050

(22) Filed: Aug. 27, 1998

(30) Foreign Application Priority Data

Aug. 29, 1997 (JP) ..... 9-234305

(51) Int. Cl.[7] ..... G08G 1/01

(52) U.S. Cl. ..... 340/933; 340/572.1; 340/572.8; 340/941; 428/928; 148/304; 148/311

(58) Field of Search ..... 340/572.1, 572.8, 340/933, 941; 148/304, 311; 428/928

(56) References Cited

U.S. PATENT DOCUMENTS 4,510,490 A * 4/1985 Anderson, III et al. .. 340/572.1
5,420,569 A * 5/1995 Dames et al. ..... 340/572
5,437,197 A * 8/1995 Uras et al. ..... 73/862.69

FOREIGN PATENT DOCUMENTS

DE 33 13 777 A1 * 6/1996
EP 0 405 764 A1 * 8/1997
EP 0 620 536 A1 * 8/1997

OTHER PUBLICATIONS

Patent Abstracts of Japan, Publication No. 07244788, Publication Date Sep. 19, 1995.*
WO 97/04338.*

* cited by examiner

*Primary Examiner*—Daryl Pope
(74) *Attorney, Agent, or Firm*—Pearne & Gordon LLP

(57) ABSTRACT

A first magnetostrictive member 1*a* is housed in a storage section 2*f* of a first frame 2*a* and a second magnetostrictive member 1*b* is housed in a storage section 2*g* of a second frame 2*b*. They are fixed by an adhesive, etc., so as to sandwich a belt-like magnetic member 3 between the frames 2*a* and 2*b*. A sealing plate 4*a*, 4*b* is fixed to the opposite side of the frame 2*a*, 2*b*, forming a magnetostrictive resonator 5. When an electromagnetic wave is applied from the long side direction of the magnetostrictive member 1*a*, 1*b*, a magnetic field is applied to the magnetostrictive members 1*a* and 1*b*. When the frequency matches the resonance frequency of the magnetostrictive member, the magnetostrictive resonator 5 vibrates with the maximum amplitude. An electromagnetic wave emitted from the magnetostrictive member 1*a* or 1*b* can be detected based on mechanical vibration continuing for a short time still after the magnetic field is stopped.

33 Claims, 6 Drawing Sheets

MAGNETOSTRICTIVE RESONATOR, ROAD IN WHICH THE RESONATOR IS BURIED AND METHOD OF BURYING THE RESONATOR

BACKGROUND OF THE INVENTION

1. Field of the Invention

This invention relates to a magnetostrictive resonator whose presence can be detected by a magnetostrictive resonator detection apparatus based on a magnetostriction phenomenon, a road in which the magnetostrictive resonator is buried, and a method of burying the magnetostrictive resonator.

2. Description of the Related Art

In recent years, application of magnetostrictive resonators has widened in such a manner that magnetostrictive resonators are buried in a road for detecting a vehicle on the road or that a magnetostrictive resonator is attached to a commodity product: in a store for finding the commodity product not yet paid for and illegally taken out at the exit of the store.

A phenomenon in which dimension change called "Joule effect" is caused by applying ani external magnetic field to ferrite, amorphous material of ferromagnetic material, etc., is referred to as a magnetostriction phenomenon. If an AC magnetic field is applied to a magnetostrictive member having such nature by a calling electromagnetic wave while a bias magnetic field like a direct current is applied to the magnetostrictive member, when the AC magnetic field gives magnetostrictive displacement to magnetostrictive resonator and the frequency of the AC magnetic field matches the resonance frequency of the magnetostrictive member, the maximum magnetostrictive displacement can be given to the magnetostrictive resonator. If the AC magnetic field caused by the calling electromagnetic wave is stopped, mechanical resonance of the magnetostrictive resonator causes an electromagnetic wave to be generated only for a short time, thus the electromagnetic wave can be detected for detecting the presence of the magnetostrictive resonator.

The detection method will be simply discussed. As shown in FIG. 9, a rectangular magnetostrictive member 31 is made of a thin plate provided by extending a ferromagnetic substance of amorphous material, etc., and a magnetized magnetic member 32 like a tape belt, for example, is placed near the magnetostrictive member 31. In this state, a calling electromagnetic wave is projected from the arrow X direction for AC excitation. When the frequency is changed and matches the resonance frequency of the magnetostrictive member 31, the magnetostrictive member 31 vibrates in the length direction thereof. FIG. 10 shows the magnetization displacement characteristic. If the magnetic member 32 does not exist, vibration of displacement width Mo is produced for AC excitation Ho; if magnetic bias Hd caused by the magnetic member 32 is applied, vibration of displacement width MA can be produced for AC excitation HA caused by the calling electromagnetic wave. If the calling electromagnetic wave is stopped, mechanical resonance of the magnetostrictive member 31 continues for a short time and the magnetostrictive member 31 is generated by a villery effect in which the magnetization state changes in response to deformation of the magnetostrictive member 31 because of a mechanical stress caused by the mechanical resonance, thus the electromagnetic wave can be detected for knowing the presence of the magnetostrictive member. If a number of magnetostrictive members different in resonance frequency are combined and placed, a combination of the resonance frequencies is detected, whereby specific information indicated by the position can also be known.

FIG. 11 shows a conventional magnetostrictive resonator example. The magnetostrictive resonator comprises two magnetostrictive members 41*a* and 41*b* like extended thin plates placed in a frame 42 and brought close to a magnetic material 43 of a ferromagnetic substance magnetized. The magnetostrictive members 41*a* and 41*b* differ in length and resonate with different resonance frequencies, thus can cover different calling frequencies.

Since the conventional magnetostrictive resonator as shown in FIG. 11 comprises a number of magnetostrictive members housed in the frame 42, the magnetostrictive members 41*a* and 41*b* may come in contact with each other depending on the attitude, causing the vibration mode to change or the frequency to shift as hindrance. It is also feared that play in the shorter magnetostrictive member 41*b* may occur in the frame 42 and the magnetostrictive member 41*b* may move in the frame, so that the magnetostrictive member goes away from a detection antenna.

SUMMARY OF THE INVENTION

It is therefore an object of the invention to provide a small and compact magnetostrictive resonator that can comprise various magnetostrictive members in combination, a road in which the magnetostrictive resonator is buried, and a method of burying the magnetostrictive resonator.

To the end, according to a first aspect of the invention, there is provided a magnetostrictive resonator comprising a belt-like magnetic member for holding a magnetic bias, a first magnetostrictive member placed facing one side of the magnetic member, a second magnetostrictive member placed facing the opposite side of the magnetic member, a first storage body provided with a storage section for storing the first magnetostrictive member, and a second storage body provided with a storage section for storing the second magnetostrictive member, so that the magnetostrictive resonator having two magnetostrictive members placed on both sides of the magnetic member can be formed small and compact.

In a second aspect of the invention, in the magnetostrictive resonator according to a first aspect of the invention, the first and second magnetostrictive members differ in length, so that the magnetostrictive resonator having two different resonance frequencies can be formed small and compact.

In a third aspect of the invention, in the magnetostrictive resonator according to a second aspect of the invention, one end in the length direction of the first magnetostrictive member and one end in the length direction of the second magnetostrictive member are at symmetrical positions with each other with the belt-like magnetic member between, so that the magnetostrictive resonator having two different resonance frequencies can be formed small and compact and the radio wave emitted from the magnetostrictive member can be detected with high sensitivity at an antenna disposed on such one end.

In a fourth aspect of the invention, in the magnetostrictive resonator according to the second or third aspect of the invention, the storage sections of the first and second storage bodies differ in dimensions matching the dimensions of the first and second magnetostrictive members stored in the first and second storage bodies, so that play in the magnetostrictive member in the storage section can be eliminated.

In a fifth aspect of the invention, in a first aspect of the magnetostrictive resonator, the belt-like magnetic member is magnetized on both sides as different patterns, so that if the size of the magnetostrictive member or the storage section in the frame is not changed, the resonance frequency can be changed only by changing the magnetization method and the types of parts can be lessened.

According to a sixth aspect of the invention, there is provided a magnetostrictive resonator comprising a belt-like magnetic member for holding a magnetic bias, a plurality of magnetostrictive members facing one side of the magnetic member and being aligned in the length direction, and a storage body provided with a storage section for separately storing the magnetostrictive members. According to a seventh aspect of the invention, there is provided a magnetostrictive resonator comprising a belt-like magnetic member for holding a magnetic bias, a plurality of magnetostrictive members facing one side of the belt-like magnetic member and being placed so that the long sides of the magnetostrictive members are aligned, and a storage body provided with a storage section for separately storing the magnetostrictive members. Thus, the magnetostrictive resonator having a plurality of magnetostrictive members can be formed small and compact.

According to an eighth aspect of the invention, there is provided a magnetostrictive resonator comprising a belt-like magnetic member for holding a magnetic bias, a plurality of magnetostrictive members facing one side of the magnetic member and being aligned in the length direction and a lateral direction, and a storage body provided with a storage section for separately storing the magnetostrictive members. The storage body has a structure as provided by combining the sixth and seventh aspects of the invention, and the magnetostrictive resonator having more magnetostrictive members can be formed small and compact.

In a ninth aspect of the invention, the magnetostrictive resonator as claimed in any of the sixth to eighth aspects of the invention further includes a storage body provided with a storage section facing the opposite side of the belt-like magnetic member for separately storing a plurality of magnetostrictive members. The magnetostrictive resonator having a large number of magnetostrictive members on both sides of the belt-like magnetic member can be formed small and compact.

In a tenth aspect of the invention, in the magnetostrictive resonator as claimed in any of the sixth to ninth aspects of the invention, the magnetostrictive members differ in length, so that the magnetostrictive resonator having different resonance frequencies can be formed small and compact.

In an eleventh aspect of the invention, in a tenth aspect of the magnetostrictive resonator, the storage section of the storage body differ in dimensions matching dimensions of the magnetostrictive members stored in the storage body, so that play in the magnetostrictive member in the storage section can be eliminated.

In a twelfth aspect of the invention, in the sixth, eighth or ninth aspects of the invention, the magnetostrictive resonator as defined in the sixth, eighth or ninth aspect, the magnetostrictive members differ in length and are arranged in the length order in the length direction. The longer the magnetostrictive member, the stronger an electromagnetic wave emitted. Thus, the magnetostrictive resonator having different resonance frequencies can be formed small and compact and radio waves emitted from all magnetostrictive members can be detected with high sensitivity at an antenna disposed on the side of the shorter magnetostrictive member.

In a thirteenth aspect of the invention, in the magnetostrictive resonator as claimed in any of the seventh to tenth aspects of the invention, one end in the length direction of one magnetostrictive member is adjacent to one end in the length direction of another magnetostrictive member, so that the magnetostrictive resonator having different resonance frequencies can be formed small and compact and radio waves emitted from the magnetostrictive members can be detected with high sensitivity at an antenna disposed on such one end.

In a fourteenth aspect of the invention, in the magnetostrictive resonator as claimed in any of the sixth to ninth aspects of the invention, the belt-like magnetic member comprises different magnetization patterns corresponding to the magnetostrictive members. Thus, the resonance frequency can be changed simply by changing the magnetization method without changing the size of the magnetostrictive member or the storage section in the frame, and the types of parts can be decreased.

In a fifteenth aspect of the invention, in the magnetostrictive resonator as defined in the seventh aspect of the invention, the magnetostrictive members are spaced a predetermined distance apart and the length of the belt-like magnetic member in the same direction as the lateral direction of the magnetostrictive member, namely, the short side direction thereof is longer than the length in the same direction as the length direction of the magnetostrictive member. The magnetostrictive resonator can be detected with high sensitivity if the antenna of a magnetostrictive resonator detection apparatus is moved at high speed in the arrangement direction of the magnetostrictive members of the magnetostrictive resonator.

According to a sixteenth aspect of the invention, there is provided a road wherein if a magnetostrictive resonator as defined in the third aspect of the invention is used, the side where one end in the length direction of the first magnetostrictive member and one end in the length direction of the second magnetostrictive member are at symmetrical positions with each other with the belt-like magnetic member between is buried closer to a road face than the opposite end, and wherein if a magnetostrictive resonator according to the thirteenth aspect of the invention is used, the side where one end in the length direction of one magnetostrictive member is adjacent to one end in the length direction of another magnetostrictive member is buried closer to a road face than the opposite end. Since the magnetostrictive members are placed on the side close to the road surface, a radio wave emitted from each magnetostrictive member can be detected with high sensitivity at an antenna installed on a vehicle.

According to a seventh aspect of the invention, there is provided a road wherein a magnetostrictive resonator as defined in the twelfth aspect of the invention is buried with a longer magnetostrictive member away from a road face. Since the longer magnetostrictive member emits a stronger electromagnetic wave, radio waves emitted from all magnetostrictive members can be detected with high sensitivity at an antenna installed on a vehicle.

According to an eighteenth aspect of the invention, there is provided a road wherein a magnetostrictive resonator as defined in the fifteenth aspect of the invention is buried so that a plurality of magnetostrictive members are aligned in the vehicle travel direction. Thus, high-sensitivity detection is enabled if the antenna of a magnetostrictive resonator detection apparatus is moved at high speed in the arrangement direction of the magnetostrictive members of the magnetostrictive resonator.

According to a ninteenth aspect of the invention, there is provided a magnetostrictive resonator burying method, if a magnetostrictive resonator as defined in the third aspect of the invention is used, comprising the step of burying the magnetostrictive resonator so that the side where one end in the length direction of the first magnetostrictive member and one end in the length direction of the second magnetostrictive member are at symmetrical positions with each other with the belt-like magnetic member between becomes closer to the buried face than the opposite end, if a magnetostrictive resonator as defined in the thirteenth aspect of the invention is used, comprising the step of burying the magnetostrictive resonator so that the side where one end in the length direction of one magnetostrictive member is adjacent to one end in-the length direction of another magnetostrictive member-becomes closer to the buried face than the opposite end. Since the magnetostrictive members are placed on the side close to the buried face, a radio wave emitted from each magnetostrictive member can be detected with high sensitivity at a detection antenna.

According to a twentieth aspect of the invention, there is provided a magnetostrictive resonator burying method comprising the step of burying a magnetostrictive resonator as defined in the twelfth aspect of the invention so that a longer magnetostrictive member is away from the buried face. Since the longer magnetostrictive member emits a stronger electromagnetic wave, radio waves emitted from all magnetostrictive members can be detected with high sensitivity at an antenna installed on a vehicle.

According to a 21-st aspect of the invention, there is provided a magnetostrictive resonator burying method comprising the step of burying a magnetostrictive resonator as defined in the fifteenth aspect of the invention so that a plurality of magnetostrictive members are aligned in the vehicle travel direction. Thus, high-sensitivity detection is enabled if the antenna of a magnetostrictive resonator detection apparatus is moved at high speed in the arrangement direction of the magnetostrictive members of the magnetostrictive resonator.

DETAILED DESCRIPTION OF THE PREFERRED EMBODIMENTS

Referring now to the accompanying drawings, there are shown preferred embodiments of the invention.

(First embodiment)

Figure 1:
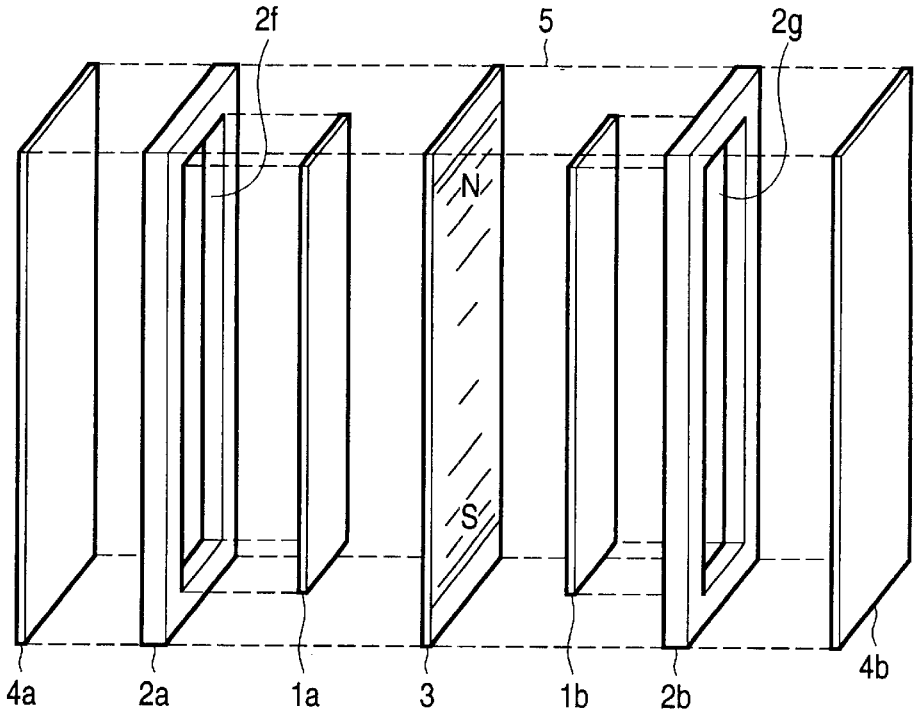
FIG. 1 is an assembly view of a magnetostrictive resonator of a first embodiment of the invention.

FIG. 1 is an assembly view of a magnetostrictive resonator of a first embodiment of the invention. In the figure, numerals 1*a* and 1*b* are rectangular magnetostrictive members of the same dimensions made of thin plates provided by extending amorphous material, etc., of a ferromagnetic substance, etc. When the magnetostrictive members 1*a* and 1*b* are given a static magnetic bias from the outside and receive an AC electric field or magnetic field, they perform mechanical vibration in the length direction thereof. A ferromagnetic substance of ferrite, etc., can also be used for the magnetostrictive member. Numerals 2*a* and 2*b* are non-magnetic and non-conductive frames of the same outer dimensions thicker than the magnetostrictive members 1*a* and 1*b*. The frame 2*a*, 2*b* is formed so that a storage section 2*f*, 2*g* has a slight gap on left and right and top and bottom with respect to the outer dimensions of the magnetostrictive member 1*a*, 1*b* corresponding to the storage section 2*f*, 2*g*. Numeral 3 is a belt-like magnetic member provided by coating both sides of a nonconductive base material, such as plastic, with a ferromagnetic substance and magnetized on a pattern as shown in FIG. 1. Numeral 4*a*, 4*b* is a member for sealing an opening on the side of the storage section 2*f*, 2*g* of the frame 2*a*, 2*b* not facing the belt-like magnetic member 3 and is a sealing plate made of a non-magnetic and non-conductive substance, such as plastic, cut as the same outer dimensions as the frame 2*a*, 2*b*.

The first magnetostrictive member 1*a* is housed in the storage section 2*f* of the first frame 2*a* and the second magnetostrictive member 1*b* is housed in the storage section 2*g* of the second frame 2*b*. They are fixed by an adhesive, etc., so as to sandwich the belt-like magnetic member 3 between the frames 2*a* and 2*b*. They may be fixed by joining means such as ultrasonic welding in place of the adhesive. The sealing plate 4*a*, 4*b* is fixed to the opposite side of the frame 2*a*, 2*b* by a method such as bonding or ultrasonic welding. In doing so, slight gaps exist between long and short sides of the magnetostrictive member 1*a*, 1*b* and the inner walls of the storage section of the frame 2*a*, 2*b* and thus expansion and contraction caused by vibration in the length direction are not hindered.

When an electromagnetic wave is applied to a magnetostrictive resonator 5 thus configured along the long side direction of the magnetostrictive member 1*a*, 1*b*, a magnetic field is applied to the magnetostrictive members 1*a* and 1*b*. When the frequency matches the resonance frequency of the magnetostrictive member, the magnetostrictive resonator 5 vibrates with the maximum amplitude. An electromagnetic wave emitted from the magnetostrictive member 1*a* or 1*b* can be detected based on mechanical vibration continuing for a short time still after the magnetic field is stopped.

According to the embodiment, the magnetostrictive members 1*a* and 1*b* are housed in their respective storage sections 2*f* and 2*g* of the separate frames 2*a* and 2*b*. Unlike the conventional magnetostrictive resonator in FIG. 11, the magnetostrictive members do not abut each other at the resonance time and thus do not affect each other. Since the magnetostrictive members 1*a* and 1*b* are placed on both sides of the belt-like magnetic member 3, the width of the belt-like magnetic member 3, namely, the width of each frame may be about a half as compared with that in the conventional magnetostrictive resonator in FIG. 11; a small and compact magnetostrictive resonator can be provided.

(Second embodiment)

Figure 2:
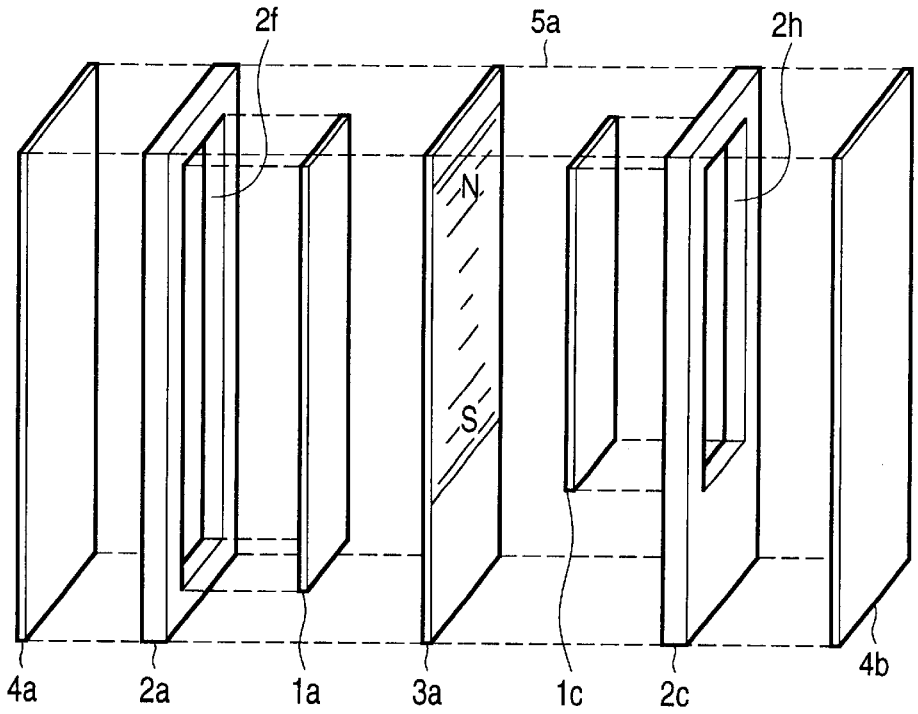
FIG. 2 is an assembly view of a magnetostrictive resonator of a second embodiment of the invention.

FIG. 2 is an assembly view of a magnetostrictive resonator of a second embodiment of the invention. Parts identical with or similar to those previously described with reference to FIG. 1 are denoted by the same reference numerals in FIG. 2 and will not be discussed again. The second embodiment differs from the first embodiment in that a second magnetostrictive member 1*c* has long sides shorter than a first magnetostrictive member 1*a*. The short side length may be the same as that of the first magnetostrictive member 1*a* or may be changed in response to the long side length. A second frame 2*c* has the same outer dimensions as a first frame 2*a*, but in the inner dimensions of a storage section 2*h* of the second frame 2*c*, the long sides are shortened matching the second magnetostrictive member 1*c* for lessening play in the magnetostrictive member 1*c* in the storage section 2*h*.

Generally, the shorter the long side length, the larger the resonance frequency if the same material having the same thickness is applied. Thus, a magnetostrictive resonator 5*a* comprising a number of magnetostrictive members different in resonance frequency in one piece can be provided. Of course, the first magnetostrictive member 1*a* may have long sides shorter than the second magnetostrictive member 1*c*.

The magnetostrictive resonator 5*a* of the embodiment described can be provided as a small and compact magnetostrictive resonator having two resonance frequencies because the two magnetostrictive members differ in length.

As seen in FIG. 2, the frames 2*a* and 2*c* have the same outer dimensions, but the long sides of the inner dimensions of the storage section 2*h* of the second frame 2*c* are made small matching magnetostrictive member length. Then, the upper frame width of the frame 2*a*, 2*c* is made the minimum for holding the magnetostrictive member and both frames are made the same at inner position of upper storage section. The lower-part of the frame 2*c* becomes wide. That is, the magnetostrictive member in the frame is also placed upward and the short side at the upper end in the length direction of the magnetostrictive member 1*a* and the short side at the upper end in the length direction of the magnetostrictive member 1*c* become symmetrical positions with each other with a belt-like magnetic member 3 between.

When the described magnetostrictive resonator 5*a* is applied to a magnetostrictive resonator detection apparatus, if an electromagnetic wave is given from above the magnetostrictive resonator 5*a*, particularly when a minute electromagnetic wave generated by mechanical vibration is detected, the magnetostrictive members 1*a* and 1*c* move upward near a detection antenna, so that the detection sensitivity of the magnetostrictive resonator detection apparatus can be enhanced.

(Third embodiment)

Figure 3A:
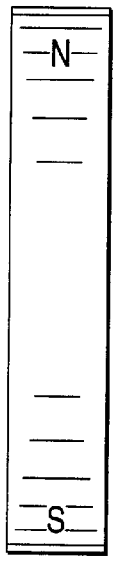
FIGS. 3A to 3C are illustrations to show a belt-like magnetic member magnetization method in a third embodiment of the invention.
Figure 3B:
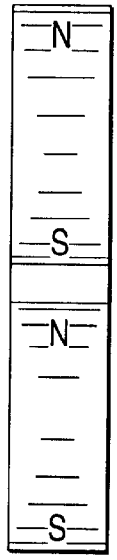
Figure 3C:
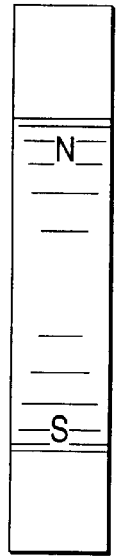

In FIG. 1 showing the first embodiment, the magnetostrictive members 1*a* and 1*b* have the same dimensions and thus have the same resonance frequency. To provide the magnetostrictive members 1*a* and 1*b* with different resonance frequencies, the magnetization pattern of belt-like magnetic member 3 is changed. FIGS. 3A to 3C are illustrations to show an example of a magnetization method of the belt-like magnetic member 3; FIG. 3A is a magnetization pattern of the side of the belt-like magnetic member 3 facing first magnetostrictive member 1*a* and FIG. 3B is a magnetization pattern of the side of the belt-like magnetic member 3 facing second magnetostrictive member 1*b*. By thus providing the different magnetization patterns, the vibration mode of the first gagnetostrictive member 1*a* becomes a vibration mode with a node at each end and the vibration mode of the second magnetostrictive member 1*b* becomes a vibration mode with a node at a midpoint; the resonance frequency rises.

To change the magnetization pattern, the vibration range may be limited by magnetizing at a midpoint of the length of the magnetostrictive member as shown in FIG. 3C, thereby raising the resonance frequency.

Thus, according to the embodiment, the resonance frequency can be changed simply by changing the magnetization method without changing the magnetostrictive member size. Therefore, the frame dimensions need not be changed either, the types of parts can be decreased, labor for parts order and inventory management can be saved, and the manufacturing process can be rationalized. Of course, the embodiment may be applied to the magnetostrictive resonator of the second embodiment.

(Fourth embodiment)

Figure 4:
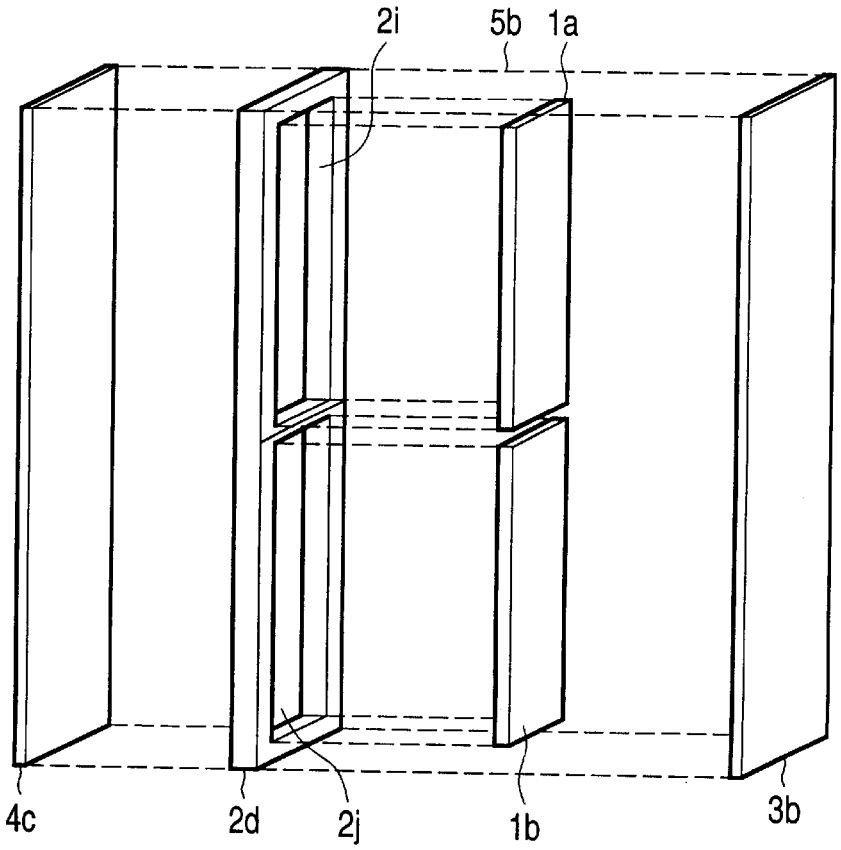
FIG. 4 is an assembly view of a magnetostrictive resonator of a fourth embodiment of the invention.

FIG. 4 is an assembly view of a magnetostrictive resonator of a fourth embodiment of the invention. Parts identical with or similar to those previously described with reference to FIG. 1 and FIG. 2 are denoted by the same reference numerals in FIG. 4 and will not be discussed again. Storage sections 2*i* and 2*j* are installed in a frame 2*d* so that a first magnetostrictive member 1*a* and a second magnetostrictive member 1*b* are aligned in the length direction, namely, the short sides of the magnetostrictive members 1*a* and 1*b* are adjacent to each other. A belt-like magnetic member 3*b* coated with a magnetic film of ferromagnetic substance at least on one side of base material facing the magnetostrictive members 1*a* and 1*b* and magnetized as a specific pattern at the positions corresponding to the magnetostrictive members is fixed to one side of the frame 2*d* and a sealing plate 4*c* is fixed to the opposite side of the frame 2*d* by a method such as bonding, thereby making up a magnetostrictive resonator 5*b*. Here, two magnetostrictive members are provided, but three or more magnetostrictive members can be provided.

The magnetostrictive members may differ in length or some may have the same dimensions. Therefore, the inner dimensions of frames of portions for housing the magnetostrictive members are made the dimensions corresponding to the housed magnetostrictive members.

Thus, according to the embodiment, one magnetostrictive resonator containing more than one magnetostrictive member can be made compact and the magnetostrictive members are provided with the same resonance frequency for enhancing the detection sensitivity or a magnetostrictive resonator having different resonance frequencies can be provided.

In the embodiment, if the magnetostrictive members differ in length, they are arranged in the length order in such a manner that the shortest magnetostrictive member is placed on the top and that the longest one is placed on the bottom, thereby forming a magnetostrictive resonator. When the magnetostrictive resonator is applied to a magnetostrictive resonator detection apparatus, if an electromagnetic wave is given from above the magnetostrictive resonator, particularly when a minute electromagnetic wave generated by mechanical vibration is detected, the longer the magnetostrictive member, the lower the resonance frequency and the stronger the generated electromagnetic wave. Thus, if the longer magnetostrictive members are placed at lower positions, the whole sensitivity is made even and the detection sensitivity of the magnetostrictive resonator detection apparatus can be enhanced.

(Fifth embodiment)

Figure 5:
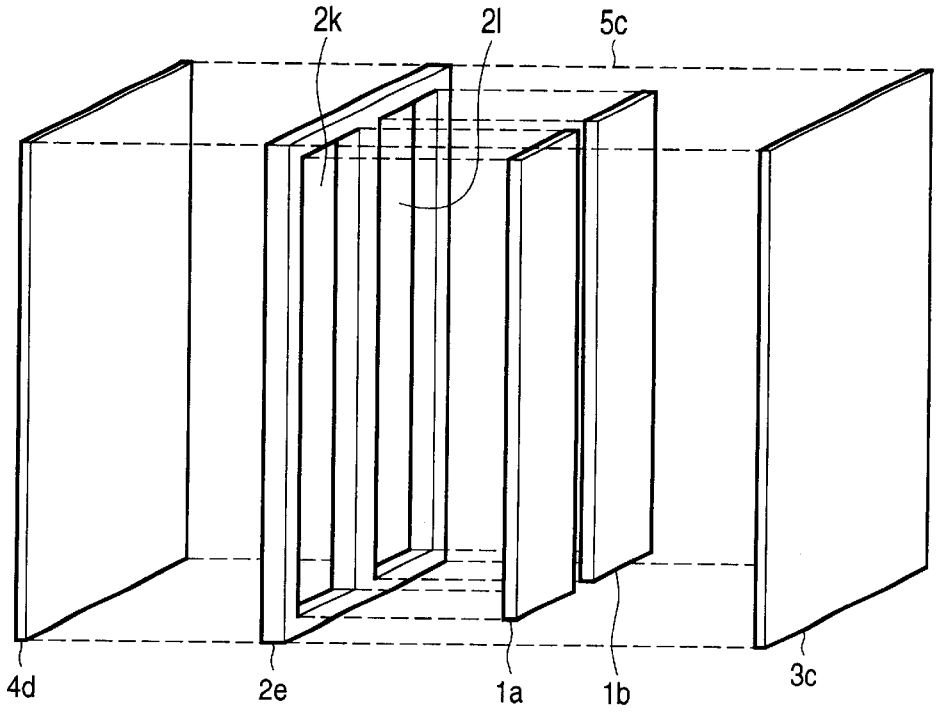
FIG. 5 is an assembly view of a magnetostrictive resonator of a fifth embodiment of the invention.

FIG. 5 is an assembly view of a magnetostrictive resonator of a fifth embodiment of the invention. Parts identical with or similar to those previously described with reference to FIG. 1 and FIG. 2 are denoted by the same reference numerals in FIG. 5 and will not be discussed again. Storage sections 2*k* and 2*l* are installed in a frame 2*e* so that a first magnetostrictive member 1*a* and a second magnetostrictive member 1*b* are aligned in a lateral direction, namely, the long sides of the magnetostrictive members 1*a* and 1*b* are adjacent to each other.

A belt-like magnetic member 3*c* coated with a magnetic film of ferromagnetic substance at least on one side of base material facing the magnetostrictive members 1*a* and 1*b* and magnetized as a specific pattern at the positions corresponding to the magnetostrictive members is fixed to one side of the frame 2*e* by a method such as bonding and a sealing plate 4*d* having the same outer dimensions as the frame 2*e* is fixed to the opposite side of the frame 2*e* by a method such as bonding, thereby making up a magnetostrictive resonator 5*c*. Here, two magnetostrictive members are provided, but if the frame 2*e* is enlarged and one or more storage sections are added, three or more magnetostrictive members can be provided.

Figure 11:
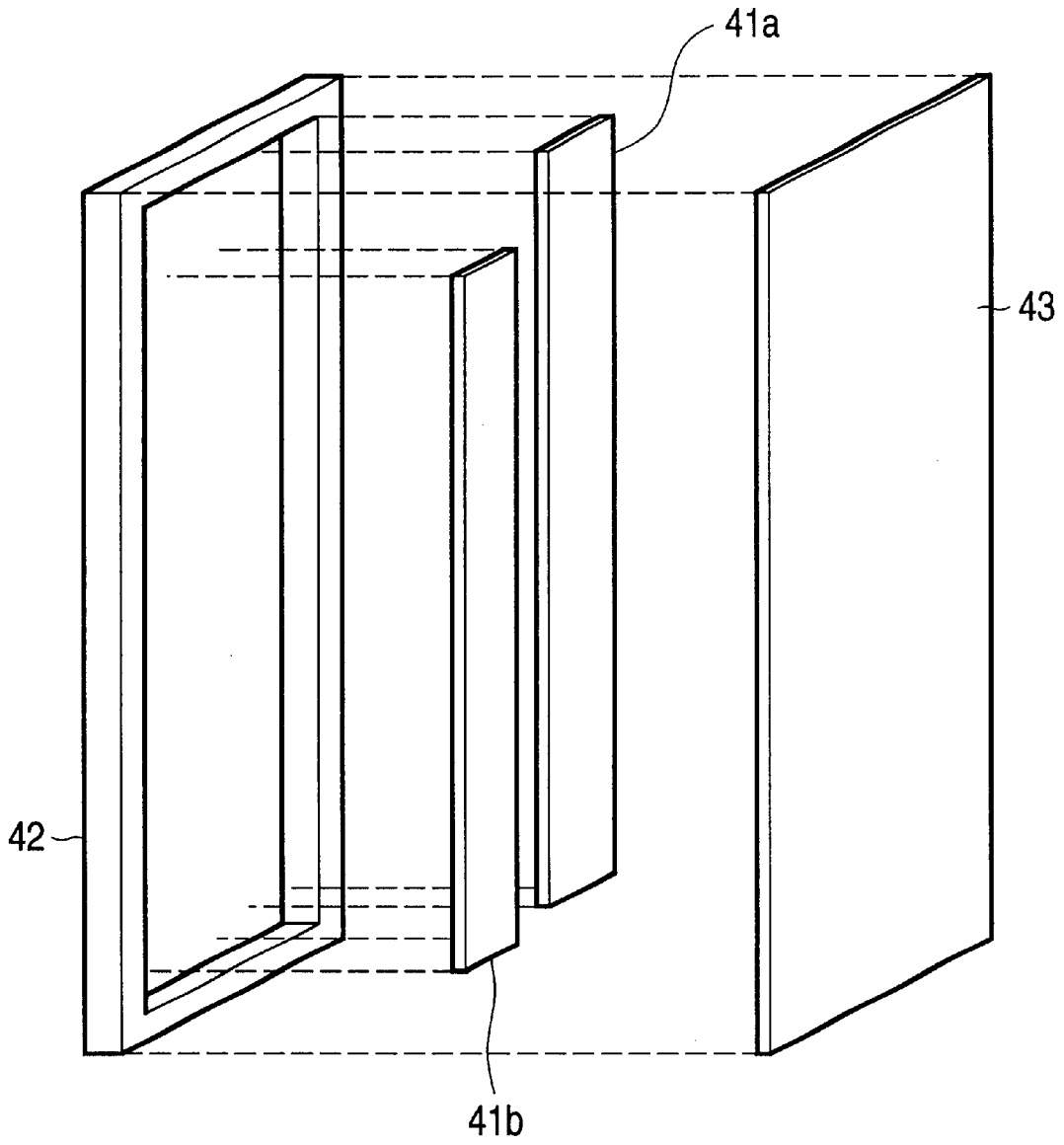
FIG. 11 is a perspective view to show the structure of a conventional magnetostrictive resonator example.

Unlike the conventional magnetostrictive resonator in FIG. 11, the magnetostrictive members according to the embodiment do not abut each other at the resonance time and thus do not affect each other.

The magnetostrictive members may differ in length or some may have the same dimensions. Therefore, the inner dimensions of frames of portions for housing the magnetostrictive members are made the dimensions corresponding to the housed magnetostrictive members.

Thus, as in the fourth embodiment, one magnetostrictive resonator containing more than one magnetostrictive member can be made compact and the magnetostrictive members are provided with the same resonance frequency for enhancing the detection sensitivity or a magnetostrictive resonator having different resonance frequencies can be provided.

In the fifth embodiment, if the magnetostrictive members differ in length, they are arranged in such a manner that one end in the length direction of one magnetostrictive member, for example, the upper end is adjacent to the upper end in the length direction of another magnetostrictive member, thereby forming a magnetostrictive resonator. When the magnetostrictive resonator is applied to a magnetostrictive resonator detection apparatus, if an electromagnetic wave is given from above the magnetostrictive resonator, particularly when a minute electromagnetic wave generated by mechanical vibration is detected, all magnetostrictive members can be brought close to a detection antenna as much as possible. Thus, the detection sensitivity of the magnetostrictive resonator detection apparatus can be enhanced.

(Sixth embodiment)

The structures of the fourth and fifth embodiments can also be combined, of course. That is, the magnetostrictive members are placed in the frame 2*d* in FIG. 4 so that the end sides of the magnetostrictive members are adjacent to each other. In the placement, more magnetostrictive members can also be housed in one frame so that the long sides of the magnetostrictive members are adjacent to each other as in the frame 2*e* in FIG. 5, namely, at least four or more magnetostrictive members can also be housed in one frame. In this case, the magnetostrictive members may have the same dimensions or different dimensions.

If the used magnetostrictive members differ in length, they are aligned at end side positions or are arranged in the length order, whereby the magnetostrictive resonator can be formed in such a manner that the shortest magnetostrictive member is placed on the top and that the longest one is placed on the bottom, for example.

(Seventh embodiment)

In the fourth to sixth embodiments, the belt-like magnetic member is coated on both sides with a magnetic film of ferromagnetic substance and is magnetized as a specific pattern at positions corresponding to the magnetostrictive members and a frame housing magnetostrictive members is installed on each side of the belt-like magnetic member, whereby a magnetostrictive resonator having a large number of magnetostrictive members can be formed. In this case, the magnetostrictive members may have the same dimensions or different dimensions. If the used magnetostrictive members differ in length, they are aligned at end side positions or are arranged in the length order, whereby the magnetostrictive resonator can be formed in such a manner that the shortest magnetostrictive member is placed on the top and that the longest one is placed on the bottom, for example, as in the sixth embodiment.

(Eighth embodiment)

In an eighth embodiment of the invention, the belt-like magnetic member is magnetized in portions corresponding to the magnetostrictive members in the fourth to seventh embodiments as different patterns by the method as described in the third embodiment, whereby if the magnetostrictive members differ in outer dimensions, they can be provided with different resonance frequencies; the types of parts can be decreased and the manufacturing process can be rationalized. Of course, the eighth embodiment may be applied to magnetostrictive members different in length.

(Ninth embodiment)

Figure 6:
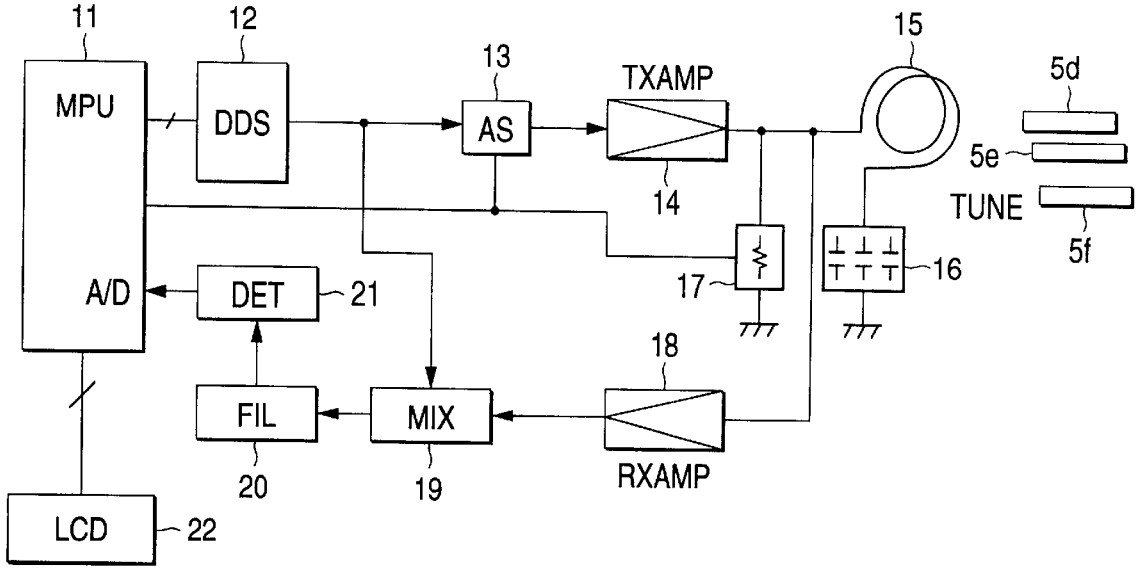
FIG. 6 is a block diagram of a magnetostrictive resonator detection apparatus in a ninth embodiment of the invention.

A magnetostrictive resonator detection apparatus using magnetostrictive resonators described in the preceding embodiments and an application example of the detection apparatus to a traffic system will be discussed. FIG. 6 is a block diagram of a magnetostrictive resonator detection apparatus in a ninth embodiment of the invention. In the figure, numeral 11 is a microprocessing unit (MPU) for controlling the magnetostrictive resonator detection apparatus, numeral 12 is a direct digital synthesizer (DDS) for oscillating the resonance frequency of a magnetostrictive resonator to be detected and the difference frequency between the resonance frequency and an intermediate frequency, numeral 13 is a transmission and reception switch section for switching transmission and reception, numeral 14 is a transmission amplifier, numeral 15 is an antenna used for both transmission and reception, numeral 16 is a tuning capacitor section wherein an optimum capacitor is selected in response to transmitted or received resonance frequency, numeral 17 is a discharge resistor activated for a short time just after the transmission termination at the switching time from transmission to reception, numeral 18 is a reception amplification section for amplifying a received signal, numeral 19 is an intermediate frequency conversion section for converting a received frequency into an intermediate frequency, numeral 20 is a filter section for decreasing noise other than the intermediate frequency, numeral 21 is an amplification detector section, and numeral 22 is a display section for specifying and displaying the frequency of the detected magnetostrictive resonator and displaying the detection level thereof on a bar graph, etc.

Figure 7:
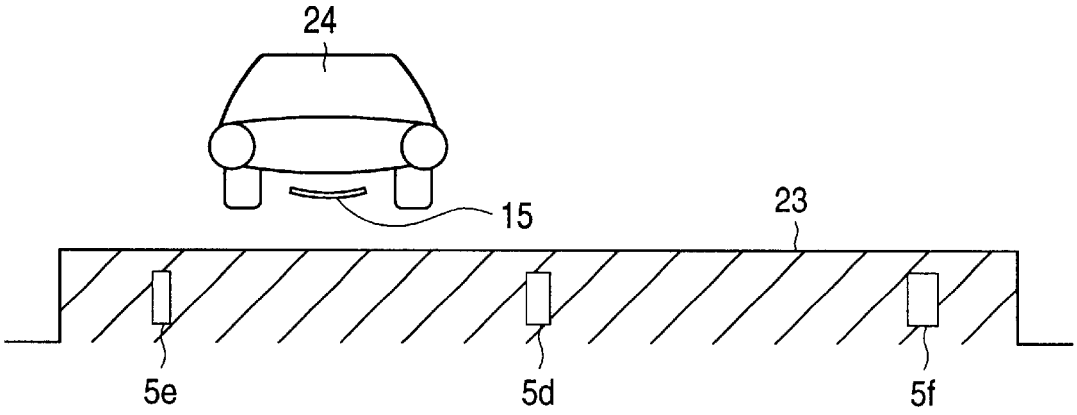
FIG. 7 is an illustration to show placement of magnetostrictive resonators buried in a road in the ninth embodiment of the invention.

Here, three magnetostrictive resonators 5*d*, 5*e*, and 5*f* are used. For example, the resonance frequencies of the magnetostrictive resonators can be set roughly at 30-kHz steps from 90 kHz to higher frequencies and can be selected up to 445 kHz preceding commercial medium wave broadcasting frequencies. For example, in FIG. 7, which is an illustration to show placement of the magnetostrictive resonators buried in a road, the embodiment assumes that the median strip magnetostrictive resonator 5*d* has resonance frequency f1 set to 210 kHz, that the up road shoulder magnetostrictive resonator 5*e* has resonance frequency f2 set to 240 kHz, and that the down road shoulder magnetostrictive resonator 5*f* has resonance frequency f3 set to 270 kHz, the magnetostrictive resonators having the top faces buried about 5 to 10 cm under the road face.

In operation, the MPU 11 causes the DDS12 to oscillate the resonance frequency f1 of the first magnetostrictive resonator 5*d*, sets the transmission and reception switch section 13 to transmission, amplifies power by the transmission amplifier 14, and outputs an electromagnetic wave from the antenna 15. At this time, an optimum capacitor for the frequency to be transmitted (in this case, f1) is selected in the tuning capacitor section 16 and is connected to a return terminal of the antenna 15 in series. The electromagnetic wave is thus emitted to the first magnetostrictive resonator 5*d*. If the first magnetostrictive resonator 5*d* is in the resonance range, a resonance state is entered. Next, reception mode is entered. Before switching to reception, the discharge resistor 17 is activated for a short time.

Next, the difference frequency between intermediate frequency fc (for example, 3.58 MHz) and the resonance frequency ft of the first magnetostrictive resonator 5*d* is oscillated from the DDS 12 to produce a local oscillation signal of the intermediate frequency conversion section 19. At the same time, the transmission and reception switch section 13 is switched to reception. An electromagnetic wave echo signal generated due to resonance of the first magnetostrictive resonator 5*d* is input through the antenna 15 to the reception amplification section 18 for high-frequency amplification. At this time, the same value remains selected in the tuning capacitor section 16. The echo signal is converted into an intermediate frequency by the intermediate frequency conversion section 19.

Next, noise other than the intermediate frequency fc is attenuated through the filter section 20. Further, the signal is amplified to reception level and detected by the amplification detector section 21 and is input to the MPU 11 through A/D converter input thereof and operation processing is performed on the signal. The result is displayed on the display section 22.

Subsequently, to determine the second magnetostrictive resonator 5*e* for an up road shoulder and the third magnetostrictive resonator 5*f* for a down road shoulder, a similar procedure to that described above is repeated cyclically for the resonance frequencies f2 and f3 for determining the position on the road. At this time, selection is executed in the DDS12 and the tuning capacitor section 16 in a similar manner to that described above. If the magnetostrictive resonator detection result is not only displayed on the display section 22, but also computed by the MPU 11 for converting the vehicle position relative to the detected magnetostrictive resonator into a numeric value and the detection apparatus is operatively associated with a navigation system, automatic navigation is also enabled so as to properly hold the vehicle position relative to the road.

In the embodiment, the magnetostrictive resonators having three different resonance frequencies are used. For example, if a magnetostrictive resonator containing a number of magnetostrictive members having different resonance frequencies as in the second, third, or eighth embodiment is used as a median strip magnetostrictive resonator 5*g* and is provided with resonance frequencies f1 set to 210 kHz and f2 set to 240 kHz and up and down road shoulder magnetostrictive resonators 5*e* and 5*f* are provided with resonance frequencies f1 set to 210 kHz and f2 set to 240 kHz respectively and then the magnetostrictive resonators 5*g*, 5*e*, and 5*f* are placed so that a vehicle passes by the median strip magnetostrictive resonator 5*g* and the up, down road shoulder magnetostrictive resonator 5*e*, 5*f* alternately, when both f1 and f2 are detected, the magnetostrictive resonator can be recognized as the median strip magnetostrictive resonator 5*g*; when only f1 210 kHz is detected, the magnetostrictive resonator can be recognized as the up road shoulder magnetostrictive resonator 5*e*; and when only f2 240 kHz is detected, the magnetostrictive resonator can be recognized as the down road shoulder magnetostrictive resonator 5*f*. Thus, if only two frequencies are emitted, three positions can be detected, so that the detection can be speeded up. At the time, if a magnetostrictive resonator wherein the upper end in the length direction of the magnetostrictive member 1*a* and the upper end in the length direction of the magnetostrictive member 1*c* become symmetrical positions with each other with the belt-like magnetic member 3 between as described in the second embodiment, a magnetostrictive resonator comprising magnetostrictive members aligned so that the upper ends thereof are adjacent to each other as described in the fifth embodiment, or a magnetostrictive resonator comprising magnetostrictive members aligned so that the shortest magnetostrictive member is placed on the top and that the longest one is placed on the bottom as described in the fourth embodiment is buried in a road as the magnetostrictive resonator 5*g* having different resonance frequencies, the detection sensitivity of an electromagnetic wave echo signal generated due to resonance can be enhanced for the reasons described above.

(Tenth embodiment)

Figure 8A:
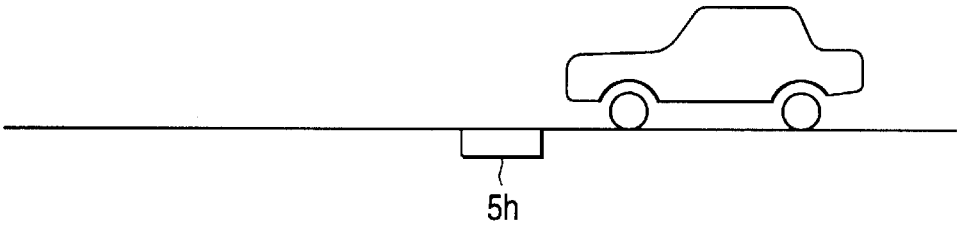
FIGS. 8A and 8B are illustrations to show a layout of a magnetostrictive resonator in a road with respect to a vehicle travel direction in a tenth embodiment of the invention.
Figure 8B:
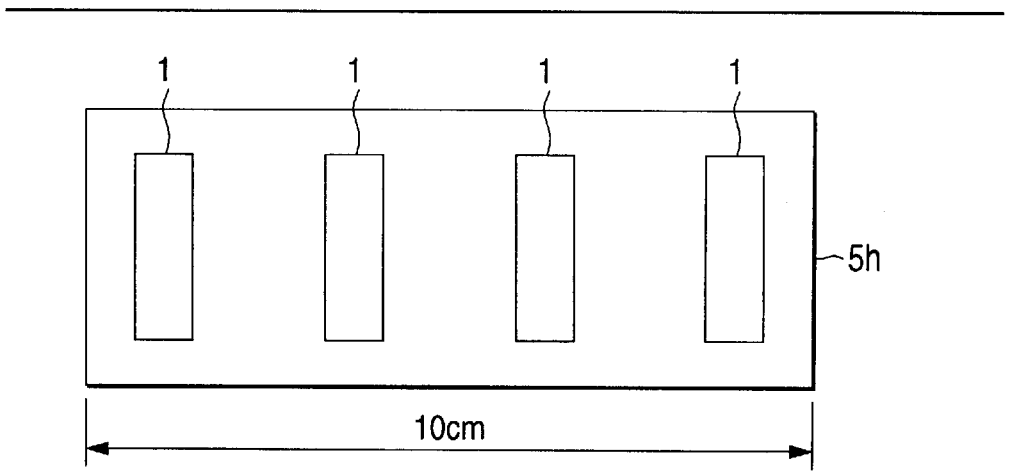
Figure 9:
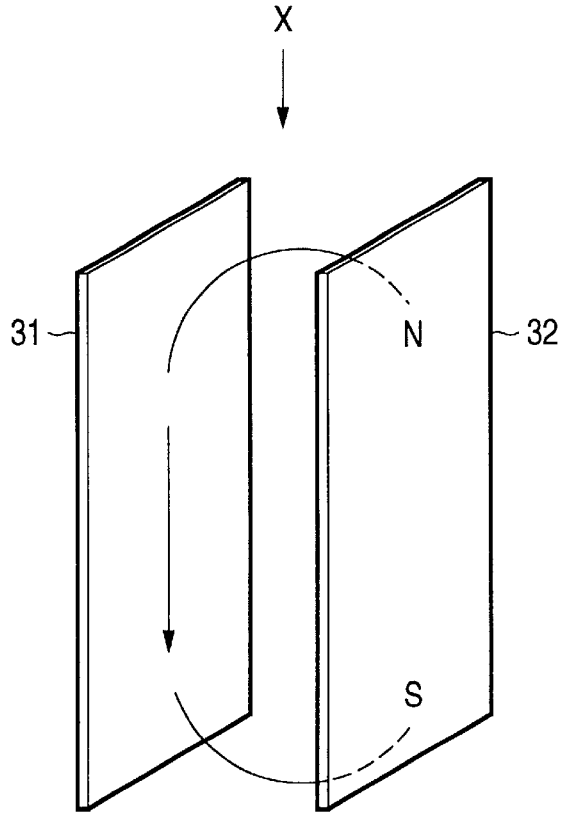
FIG. 9 is a schematic representation to show a magnetostrictive resonator detection method.
Figure 10:
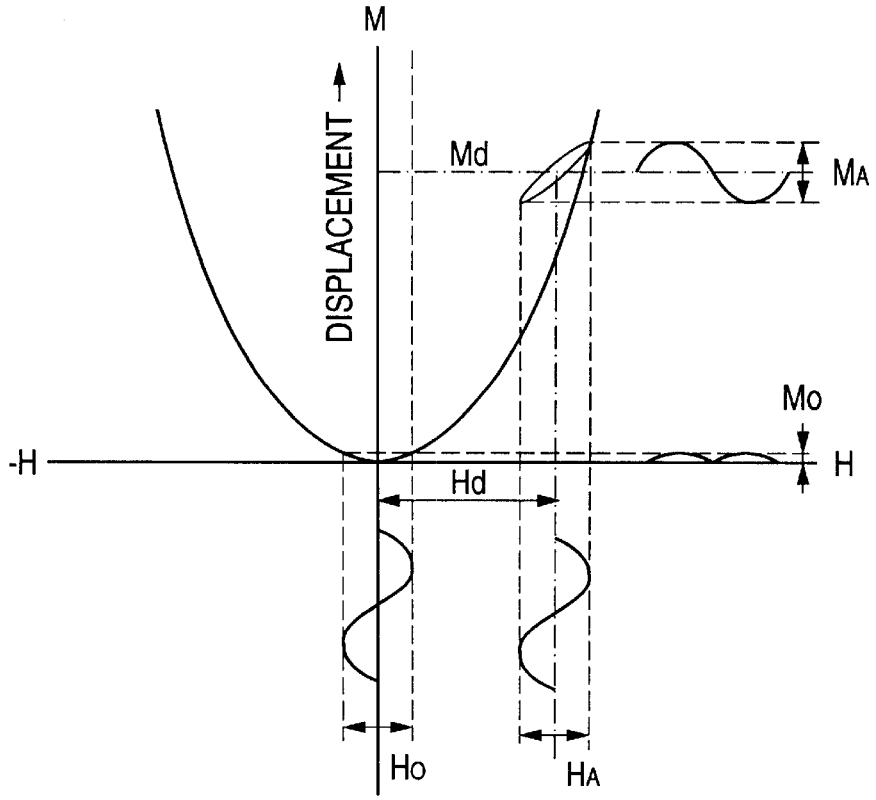
FIG. 10 is a magnetization displacement characteristic diagram of a magnetostrictive substance.

In the ninth embodiment, if the vehicle speed is fast, when an electromagnetic wave is emitted to a magnetostrictive resonator and an echo signal is about to receive, the vehicle already advances and the reception sensitivity lowers. Thus, the structure of the magnetostrictive resonator of the fifth embodiment in FIG. 5 is changed as follows: As shown in FIGS. 8A and 8B, the magnetostrictive resonators each containing a number of magnetostrictive members (in this case, four) are spaced a predetermined value apart and the lateral length of magnetic member opposed to all magnetostrictive members is set to 10 cm, for example, then the magnetostrictive resonators are buried in a road with the direction matched with the travel direction of a vehicle. FIG. 8A is a schematic drawing and 8*b* is an enlarged view of magnetostrictive resonator 5*h*. In this case, the length of the magnetic member in the same direction as the lateral direction (end side direction) of the magnetostrictive member becomes longer than the length in the same direction as the length direction of the magnetostrictive member. If an electromagnetic wave is emitted to the magnetostrictive resonator from an antenna of magnetostrictive resonator detection apparatus installed on a vehicle by the above-described method, when the mode is switched from transmission to reception, an echo signal from the magnetostrictive resonator closest to the antenna can be received. Thus, if the travel speed of the vehicle, namely, the magnetostrictive resonator detection apparatus is fast, high-sensitivity detection is enabled. In FIGS. 8A and 8B, the magnetostrictive resonator is buried with the length direction of the magnetostrictive members 1 vertical to the road face, but may be buried so as to parallel with the road face.

In the embodiments described above, the frame and the sealing plate are separate members, but if a frame integral with a lid on one side of a storage section for housing magnetostrictive members is used, the sealing plate becomes unnecessary.

The belt-like magnetic member for giving a bias magnetic field to magnetostrictive members is coated on one side or both sides of base material with ferromagnetic substance, but may be replaced with a thin plate of ferromagnetic substance.

In the ninth and tenth embodiments, only application wherein the magnetostrictive resonators are buried in a road for detecting the driving position of an automobile is described. However, the method of detecting the presence of a magnetostrictive resonator and the resonance frequency difference according to the invention can be applied to every application and the magnetostrictive resonators can be buried in a detected portion in a similar manner to that in roads described above.

Further, the numeric values such as the resonance frequencies of the magnetostrictive members and the frequencies, the dimensions, and the number of the components are all given as example and the invention is not limited to the numeric values.

As described above, according to the configuration as defined in the first aspect of the invention, the magnetostrictive resonator having two magnetostrictive members placed on both sides of the magnetic member can be formed small and compact.

According to the configuration as defined in the second aspect of the invention, the magnetostrictive resonator having two different resonance frequencies can be formed small and compact.

According to the configuration as defined in the third aspect of the invention, the magnetostrictive resonator having two different resonance frequencies can be formed small and compact and the radio wave emitted from the magnetostrictive member can be detected with high sensitivity at an antenna disposed on such one end.

According to the configuration as defined in the fourth or eleventh aspect of the invention, play in the magnetostrictive member in the storage section can be eliminated.

According to the configuration as defined in the fifth aspect or fourteenth aspect of the invention, if the size of the magnetostrictive member or the storage section in the frame is not changed, the resonance frequency can be changed only by changing the magnetization method and the types of parts can be lessened.

According to the configuration as defined in the sixth to eighth aspects of the invention, the magnetostrictive resonator having a plurality of magnetostrictive members can be formed small and compact.

According to the configuration as defined in the ninth aspect, the magnetostrictive resonator having a large number of magnetostrictive members on both sides of the belt-like magnetic member can be formed small and compact.

According to the configuration as defined in the tenth aspect of the invention, the magnetostrictive resonator having different resonance frequencies can be formed small and compact.

According to the configuration as defined in the twelfth aspect of the invention, the magnetostrictive resonator having different resonance frequencies can be formed small and compact and radio waves emitted from all magnetostrictive members can be detected with high sensitivity at an antenna disposed on the side of the shorter magnetostrictive member. According to the configuration as defined in the thirteenth asepct of the invention, the magnetostrictive resonator having different resonance frequencies can be formed small and compact and radio waves emitted from the magnetostrictive members can be detected with high sensitivity at an antenna disposed on the side where one end of one magnetostrictive member is adjacent to one end another magnetostrictive member.

If the magnetostrictive resonator as defined in the fifteenth aspect of the invention, it can be detected with high sensitivity if the antenna of a magnetostrictive resonator detection apparatus is moved at high speed in the arrangement direction of the magnetostrictive members of the magnetostrictive resonator.

In the road as defined in the sixteenth aspect of the invention in which such a magnetostrictive resonator is buried or the magnetostrictive resonator burying method as defined in the ninteenth aspect of the invention, the magnetostrictive members are placed on the side close to the road surface or the buried face, thus a radio wave emitted from each magnetostrictive member can be detected with high sensitivity at an antenna installed on a vehicle or a mobile.

According to the configuration as defined in the seventeenth aspect or the method as defined in the twenties aspect of the invention, the longer magnetostrictive member emits a stronger electromagnetic wave, thus radio waves emitted from all magnetostrictive members can be detected with high sensitivity at an antenna installed on a vehicle or a mobile.

According to the configuration as defined in the eighteenth aspect of the invention or the method as defined in the 21-st aspect of the invention, high-sensitivity detection is enabled if the antenna of a magnetostrictive resonator detection apparatus installed on a vehicle or a mobile is moved at high speed in the arrangement direction of the magnetostrictive members of the magnetostrictive resonator.

What is claimed is:

1. A magnetostrictive resonator comprising:

a belt-like magnetic member for holding a magnetic bias;

a first magnetostrictive member, having a first resonance frequency, placed facing one side of said magnetic member;

a second magnetostrictive member, having a second resonance frequency, placed facing an opposite side of said magnetic member;

a first storage body provided with a first storage section for storing said first magnetostrictive member; and a second storage body provided with a second storage section for storing said second magnetostrictive member;

wherein each magnetostrictive member mechanically vibrates with a maximum amplitude when a magnetic field having a specific frequency that matches the resonance frequency of the magnetostrictive member is produced in the vicinity of the magnetostrictive member, and a detectible electromagnetic wave is emmitted from the magnetostrictive member as a result of the induced mechanical vibration which continues for a short period of time after the magnetic field is stopped.

2. The magnetostrictive resonator as claimed in claim 1 wherein said first and second magnetostrictive members differ in length.

3. The magnetostrictive resonator as claimed in claim 2 wherein one end in a length direction of said first magnetostrictive member and one end in a length direction of said second magnetostrictive member are at symmetrical positions with each other with said belt-like magnetic member between.

4. The magnetostrictive resonator as claimed in claim 2 wherein the storage sections of said first and second storage bodies differ in dimensions matching dimensions of said first and second magnetostrictive members stored in said first and second storage bodies.

5. The magnetostrictive resonator as claimed in claim 1 wherein said belt-like magnetic member is magnetized on both sides as different patterns.

6. The magnetostrictive resonator as claimed in claim 3, side wherein a side where one end in the length direction of said first magnetostrictive member and one end in the length direction of said second magnetostrictive member are at symmetrical positions with each other with said belt-like magnetic member between being buried closer to a road surface than an opposite end.

7. The magnetostrictive resonator as claimed in claim 3, wherein the resonator is buried such that a side where one end in the length direction of said first magnetostrictive member and one end in the length direction of said second magnetostrictive member are at symmetrical positions with each other with said belt-like magnetic member between becomes closer to the buried surface than an opposite end.

8. A magnetostrictive resonator comprising:

a belt-like magnetic member for holding a magnetic bias;

a plurality of magnetostrictive members, each having a predetermined resonance frequency facing one side of said magnetic member and being aligned in a length direction; and a storage body provided with a storage section for separately storing said plurality of magnetostrictive members;

wherein each magnetostrictive member mechanically vibrates with a maximum amplitude when a magnetic field having a specific frequency that matches the resonance frequency of the magnetostrictive member is produced in the vicinity of the magnetostrictive member, and a detectible electromagnetic wave is emmitted from the magnetostrictive member as a result of the induced mechanical vibration which continues for a short period of time after the magnetic field is stopped.

9. The magnetostrictive resonator as claimed in claim 8, further including a storage body provided with a storage section facing an opposite side of said belt-like magnetic member for separately storing a plurality of magnetostrictive members.

10. The magnetostrictive resonator as claimed in claim 8, wherein said plurality of magnetostrictive members differ in length.

11. The magnetostrictive resonator as claimed in claim 10 wherein the storage section of said storage body differ in dimensions matching dimensions of said magnetostrictive members stored in said storage body.

12. The magnetostrictive resonator as claimed in claim 8 wherein said plurality of magnetostrictive members differ in length and are arranged in a length order in a length direction.

13. The magnetostrictive resonator as claimed in claim 8, wherein said belt-like magnetic member comprises different magnetization patterns corresponding to said plurality of magnetostrictive members.

14. A road wherein a magnetostrictive resonator as claimed in claim 12 is buried with a long er magnetostrictive member away from a road face.

15. A magnetostrictive resonator burying method comprising the step of burying a magnetostrictive resonator as claimed in claim 12 so that a longer magnetostrictive member is away from the buried face.

16. A magnetostrictive resonator comprising:

a belt-like magnetic member for holding a magnetic bias;

a plurality of magnetostrictive members, each having a predetermined resonance frequency, facing one side of said belt-like magnetic member and being placed so that long sides of said magnetostrictive members are aligned; and a storage body provided with a storage section for separately storing said plurality of magnetostrictive members;

wherein each magnetostrictive member mechanically vibrates with a maximum amplitude when a magnetic field having a specific frequency that matches the resonance frequency of the magnetostrictive member is produced in the vicinity of the magnetostrictive member, and a detectible electromagnetic wave is emmitted from the magnetostrictive member as a result of the induced mechanical vibration which continues for a short period of time after the magnetic field is stopped.

17. The magnetostrictive resonator as claimed in claim 16 wherein one end in the length direction of one magnetostrictive member is adjacent to one end in the length direction of another magnetostrictive member.

18. The magnetostrictive resonator as claimed in claim 16 wherein said plurality of magnetostrictive members are spaced a predetermined distance apart and wherein the length of said belt-like magnetic member in the same direction as the short side direction of said magnetostrictive member is longer than the length in the same direction as the length direction of said magnetostrictive member.

19. A road wherein a magnetostrictive resonator as claimed in claim 18 is buried so that a plurality of magnetostrictive members are aligned in a vehicle travel direction.

20. A magnetostrictive resonator burying method comprising the step of burying a magnetostrictive resonator as claimed in claim 18 so that a plurality of magnetostrictive members are aligned in a vehicle travel direction.

21. The magnetostrictive resonator as claimed in claim 16, further including a storage body provided with a storage section facing an opposite side of said belt-like magnetic member for separately storing a plurality of magnetostrictive members.

22. The magnetostrictive resonator as claimed in claim 16, wherein said plurality of magnetostrictive members differ in length.

23. The magnetostrictive resonator as claimed in claim 22 wherein the storage section of said storage body differ in dimensions matching dimensions of said magnetostrictive members stored in said storage body.

24. The magnetostrictive resonator as claimed in claim 16, wherein said belt-like magnetic member comprises different magnetization patterns corresponding to said plurality of magnetostrictive members.

25. A magnetostrictive resonator comprising:

a belt-like magnetic member for holding a magnetic bias;

a plurality of magnetostrictive members , each having a predetermined resonance frequency, facing one side of said magnetic member and being aligned in a length direction and a lateral direction; and a storage body provided with a storage section for separately storing said plurality of magnetostrictive members;

wherein each magnetostrictive member mechanically vibrates with a maximum amplitude when a magnetic field having a specific frequency that matches the resonance frequency of the magnetostrictive member is produced in the vicinity of the magnetostrictive member, and a detectible electromagnetic wave is emmitted from the magnetostrictive member as a result of the induced mechanical vibration which continues for a short period of time after the magnetic field is stopped.

26. The magnetostrictive resonator as claimed in claim 25, further including a storage body provided with a storage section facing an opposite side of said belt-like magnetic member for separately storing a plurality of magnetostrictive members.

27. The magnetostrictive resonator as claimed in claim 25, wherein said plurality of magnetostrictive members differ in length.

28. The magnetostrictive resonator as claimed in claim 27 wherein the storage section of said storage body differ in dimensions matching dimensions of said magnetostrictive members stored in said storage body.

29. The magnetostrictive resonator as claimed in claim 25, wherein said plurality of magnetostrictive members differ in length and are arranged in a length order in a length direction.

30. The magnetostrictive resonator as claimed in claim 25, wherein one end in the length direction of one magnetostrictive member is adjacent to one end in the length direction of another magnetostrictive member.

31. The magnetostrictive resonator as claimed in claim 25, wherein said belt-like magnetic member comprises different magnetization patterns corresponding to said plurality of magnetostrictive members.

32. The magnetostrictive resonator as claimed in claim 17, wherein a side where one end in the length direction of one magnetostrictive member is adjacent to one end in the length direction of another magnetostrictive member being buried closer to a road surface than an opposite end.

33. The magnetostrictive resonator burying method as claimed in claim 17, comprising the step of burying magnetostrictive resonator so that a side where one end in the length direction of one magnetostrictive member is adjacent to one end in the length direction of another magnetostrictive member becomes closer to the buried face than an opposite end.

* * * * *

UNITED STATES PATENT AND TRADEMARK OFFICE

CERTIFICATE OF CORRECTION

PATENT NO. : 6,407,676 B1
DATED : June 18, 2002
INVENTOR(S) : Tanji et al.

It is certified that error appears in the above-identified patent and that said Letters Patent is hereby corrected as shown below:

Column 1,
Line 19, after "product," please delete ":" (colon)
Line 22, please delete "ani," and insert therefor -- an --.

Column 5,
Line 11, please delete "-" between member becomes.

Column 7,
Line 61, please delete "gagnetostrictive" and insert -- magnetostricitve --.

Column 11,
Line 20, please delete "ft" and insert -- fl --.

Column 18,
Line 12, after "burying," please insert therefor -- the --.

Signed and Sealed this

Twenty-sixth Day of November, 2002

*Attest:*

*Attesting Officer*

JAMES E. ROGAN
*Director of the United States Patent and Trademark Office*